US006086339A

United States Patent [19]

Jeffrey

[11] Patent Number: 6,086,339

[45] Date of Patent: Jul. 11, 2000

[54] SOLAR-POWERED RECIPROCATING PUMP

[76] Inventor: Jacen A. Jeffrey, 903 Arlington, Wellington, Tex. 79095

[21] Appl. No.: 08/887,395

[22] Filed: Jul. 2, 1997

[51] Int. Cl.[7] ..... F04B 17/03

[52] U.S. Cl. ..... 417/415; 417/422; 417/424.2; 417/423.3; 74/25; 310/87; 92/170.1; 92/240; 92/107

[58] Field of Search ..... 417/415, 422, 417/424.2, 423.3; 74/25; 310/87; 92/170.1, 240, 107

[56] References Cited

U.S. PATENT DOCUMENTS

| | | | |
|---|---|---|---|
| 293,952 | 2/1884 | Conrad | 92/73 |
| 529,804 | 11/1894 | Pickett | 417/415 |
| 1,223,283 | 4/1917 | Kurtz | 74/25 |
| 1,240,712 | 9/1917 | Hamilton | 417/534 |
| 1,568,430 | 1/1926 | Uhl | 74/25 |
| 1,651,066 | 11/1927 | Morrison | 123/196 S |
| 1,736,094 | 11/1929 | Schmidt | 417/422 |
| 1,799,458 | 4/1931 | Ekstromer | 417/4 |
| 1,884,008 | 10/1932 | Lockhart | 74/44 |
| 1,891,771 | 12/1932 | Mendenhall et al. | 417/414 |
| 1,951,919 | 3/1934 | Arutunoff | 103/46 |
| 2,325,713 | 8/1943 | Simons | 51/67 |
| 2,445,133 | 7/1948 | Cruikshank | 74/25 |
| 2,534,428 | 12/1950 | Cruikshank | 74/25 |
| 2,569,741 | 10/1951 | Arutunoff | 310/87 |
| 2,674,194 | 4/1954 | Arutunoff | 417/414 |
| 2,918,016 | 12/1959 | Olson | 417/421 |
| 3,197,085 | 7/1965 | Deters et al. | 417/422 |
| 3,516,267 | 6/1970 | Uhlir | 66/56 |
| 3,834,242 | 9/1974 | Seybold | 74/25 |
| 3,990,816 | 11/1976 | Köhler et al. | 417/536 |
| 4,143,586 | 3/1979 | Zitting | 92/206 |
| 4,465,042 | 8/1984 | Bristol | 123/197 R |
| 4,493,614 | 1/1985 | Chu et al. | 417/22 |
| 4,523,899 | 6/1985 | Ouchi | 417/360 |
| 4,874,296 | 10/1989 | Moynihan | 417/234 |
| 4,977,817 | 12/1990 | Doman | 92/31 |
| 4,989,469 | 2/1991 | Eslinger | 74/25 |
| 5,076,769 | 12/1991 | Shao | 417/534 |
| 5,131,818 | 7/1992 | Wittkop et al. | 417/273 |
| 5,740,788 | 4/1998 | Atmur et al. | 123/668 |

FOREIGN PATENT DOCUMENTS

| | | |
|---|---|---|
| 916273 | 1/1963 | United Kingdom . |

*Primary Examiner*—Timothy S. Thorpe
*Assistant Examiner*—Robert Z. Evora
*Attorney, Agent, or Firm*—Royston, Rayzor, Vickery, Novak & Druce, L.L.P.

[57] ABSTRACT

A solar-powered reciprocating pump for submersible use in a well, such as a water well. The pump has a pumping section with a plunger therein. The pump also has a drive section with a rotating output shaft and a transmission section which converts the rotating output of the shaft into reciprocating motion of the plunger. In one embodiment, the transmission comprises a gear train. In a second embodiment, the transmission comprises a ball screw which is actuated by a reversible motor. In a third embodiment, the transmission comprises a reversible ball screw which provides reciprocating action in response to rotation of a shaft in a single direction. The pumping section comprises an outer case portion with a cylinder disposed therein such that an annular volume is defined therebetween. A system of flow passageways and inlet and outlet valves provide for pumping liquid into and out of the pump in response to movement of the plunger in both upward and downward directions. A tube which acts to seal around the plunger rod is supported on sliding bushings on the rod. A sealed end cap is provided adjacent to the drive section so that liquid which may come in contact with electrical wires externally of the pumping apparatus cannot come in contact with a motor in the drive section.

48 Claims, 5 Drawing Sheets

SOLAR-POWERED RECIPROCATING PUMP

BACKGROUND OF THE INVENTION

1. Field of the Invention

This invention relates to submersible pumps for use in water wells, and more particularly, to a positive displacement, reciprocating submersible pump which is solar powered.

2. Description of the Prior Art

Submersible pumps for use in water wells are well known. Typically, these pumps are driven by electric motors and positioned at the bottom of the well. Electrical cables run to the surface and are connected to an electric power supply, such as a household connection.

In some remote locations, it is not practical to have an electrical power supply from an electric power company. Therefore, alternative sources of energy must be utilized. One familiar alternative is a windmill which mechanically drives the pump in the well. A more recent alternative is the use of solar energy.

Submersible pumps are typically turbine-type pumps, such as centrifugal pumps. Such pumps require multiple stages with a corresponding number of centrifugal pump rotors therein to obtain the necessary pumping capacity to overcome the head of the water in the well. Centrifugal pumps are quite well known and relatively inexpensive to produce. However, such turbine-type pumps are extremely inefficient and require more electrical power to operate than a positive displacement pump of equivalent capacity. In the case of solar-powered pumps, this requires a greater number of solar cells to operate. This is a disadvantage because the solar cells are expensive and more area must be provided to accommodate them.

The pump of the present invention solves these problems by providing a solar-powered positive displacement pump utilizing a reciprocating plunger. The efficiency of such a pump is considerably greater than that of centrifugal pumps, and therefore a considerably smaller investment is necessary in cost and space for the solar panels necessary to drive it. Also, the pump of the present invention is adaptable for use with conventional power supplies, and the greater efficiency of the pump insures lower operating costs in such instances.

SUMMARY OF THE INVENTION

The present invention is a submersible pumping apparatus for use in a well. The apparatus is specifically designed for water wells, but would also be applicable for pumping other liquids. The pumping apparatus is positioned in the well at a desired depth, usually at the bottom, and is powered by electricity delivered through wires from the surface. Liquid is drawn in from the well and is pumped up a discharge pipe or conduit to the surface. The pumping apparatus is well adapted to be solar powered, but other electrical power sources could also be used.

The present invention comprises a pumping housing having an inlet and an outlet, a plunger reciprocably disposed in the pumping housing, a prime mover having a rotating output shaft, and a transmission connected to a the plunger and prime mover. The transmission is adapted for converting rotating motion of the output shaft of the prime mover into reciprocating motion of the plunger.

In one embodiment, the transmission comprises a gear train engaged with the output shaft, a connecting rod engaged with the gear train, a crosshead connected to the connecting rod, a crosshead guide in which the crosshead is slidably disposed, and a plunger rod interconnecting the crosshead and the plunger. The gear train comprises a first bevel gear attached to the output shaft, a second bevel gear having an axis substantially perpendicular to an axis of the first bevel gear with the first and second bevel gears being in geared engagement, and a plurality of speed reduction gears. One of the speed reduction gears is connected to the second bevel gear, and another of the speed reduction gears is connected to the connecting rod.

The plurality of speed reduction gears preferably comprises a first drive gear coaxial with the second bevel gear, a first driven gear engaged with the first drive gear, a second drive gear coaxial with the first driven gear, and a second driven gear engaged with the second drive gear. The drive and driven gears are preferably spur gears. A first end of the connecting rod is eccentrically attached to the second driven gear, and a second end of the connecting rod is pivotally attached to the crosshead. The driven gears are preferably larger than the drive gears.

In a second embodiment, the transmission is characterized by a ball screw interconnecting the output shaft of the prime mover with the plunger. The ball screw comprises a ball screw nut connected to the plunger, a ball screw shaft threadingly engaged with the ball screw nut and having an end connected to the output shaft of the prime mover, and means for preventing rotation of the ball screw nut. The prime mover is preferably a reversible motor which alternately reverses the rotation of the ball screw shaft so that the ball screw nut is reciprocated thereon. Sensing means may be provided for sensing a lowermost and an uppermost position of the ball screw nut.

The second embodiment may also comprise a plunger rod having a first end attached to the plunger and a second end attached to the ball screw nut. The plunger rod defines a central opening therein, and at least a portion of the ball screw shaft is disposed in the central opening.

The means for preventing rotation comprises a guide track substantially parallel to the ball screw shaft and a guide pin operatively connected with the ball screw nut and slidingly engaged with the guide track. In the illustrated embodiment, but not by way of limitation, the guide pin is attached to the lower end of the plunger rod which is connected to the ball screw nut.

In a third embodiment, the transmission is characterized by a reversing ball screw which interconnects the plunger with the output shaft of the prime mover. The reversing ball screw comprises a reversing ball screw nut connected to the plunger and a reversing ball screw shaft threadingly engaged with the reversing ball screw nut such that the ball screw nut is reciprocated along the ball screw shaft in response to rotation of the ball screw shaft in a single direction. The ball screw shaft has an end connected to the output shaft of the prime mover. The third embodiment also comprises means for preventing rotation of the ball screw nut similar to the second embodiment.

In the third embodiment, the pumping apparatus may also comprise a plunger rod similar to the plunger rod of the second embodiment.

The pumping apparatus also comprises an elastomeric tube disposed around the plunger rod. The tube has a first end sealingly attached to the plunger rod and a second end sealingly attached to the pumping housing. A plurality of bushings are disposed on the plunger rod within the tube. Each of the bushings has a generally arcuate outer surface and is slidably engaged with the plunger rod so that the tube may slide freely thereon as the plunger and plunger rod are reciprocated without the tube dragging on the outer surface of the plunger rod.

The pumping housing comprises an outer case portion with the inlet of the pumping housing being a case inlet port defined in the outer case portion, a cylinder disposed in the outer case portion such that a substantially annular volume is defined therebetween, a lower manifold, and an upper manifold. The plunger is reciprocably disposed in the cylinder such that an upper pumping chamber is defined in the cylinder above the plunger, and a lower pumping chamber is defined in the cylinder below the plunger.

The lower manifold is engaged with the outer case portion and a lower portion of the cylinder. The lower manifold defines a manifold port therein which provides communication between the lower pumping chamber and the annular volume.

The upper manifold is engaged with the outer case portion and an upper portion of the cylinder. The upper manifold defines a first inlet passageway providing communication between the case inlet port and the upper pumping chamber, a second inlet passageway providing communication between the case inlet port and the annular volume, a first outlet passageway providing communication between the upper pumping chamber and the outlet of the pumping housing, and a second outlet passageway providing communication between the annular volume and the outlet of the pumping housing.

The pumping apparatus further comprises a first inlet valve in communication with the first inlet passageway, a second inlet valve in communication with the second inlet passageway, a first outlet valve in communication with the first outlet passageway, and a second outlet valve in communication with the second outlet passageway. Each of the inlet and outlet valves is preferably characterized by a ball check valve disposed in a port forming a portion of the passageway.

A glass liner is disposed in the cylinder and engaged with the plunger in the preferred embodiment. The cylinder defines a cavity adjacent to the glass liner, and a quantity of filler material substantially fills the cavity to lock the glass liner with respect to the cylinder. The filler material is preferably an epoxy resin.

The plunger comprises a plunger body defining a bore for receiving a portion of the plunger rod therein, a first plunger ring disposed on the plunger body and adapted for sealing engagement with the glass liner and the pumping housing as the plunger moves upwardly, a second plunger ring disposed on the plunger body and adapted for sealing engagement with the glass liner and the pumping housing as the plunger moves downwardly, and means for locking the plunger body to the plunger rod. The first plunger ring and plunger body define a cavity therebetween, and the means for locking comprises a nut threadingly engaged with the plunger rod and a quantity of filler material substantially filling the cavity and enclosing at least a portion of the nut. The filler material is preferably an epoxy resin.

The prime mover is an electric motor in the preferred embodiment which has a plurality of motor wires extending therefrom. The pumping apparatus further comprises an end cap positioned adjacent to the motor with the end cap defining a cavity therein, a plurality of external wires extending externally of the pumping housing, and a plurality of electrical connectors disposed in the cavity of the end cap. Each of the connectors is adapted for electrically interconnecting one of the plurality of motor wires extending from the motor with a corresponding one of the plurality of external wires extending externally of the pumping housing. The pumping apparatus further comprises a quantity of filler material substantially filling the cavity in the end cap and enclosing at least a portion of the connector such that liquid which may be on the external wires cannot come in contact with the motor wires. The external wires and motor wires will generally be a braided type of wire, and liquid which may come in contact with the braided external wires can be moved along the external wires with a wicking action. The connectors sealed in the filler material are made solid so that no wicking can occur. The filler material is preferably an epoxy resin.

Numerous objects and advantages of the invention will become apparent as the following detailed description of the preferred embodiments is read in conjunction with the drawings which illustrate such embodiments.

BRIEF DESCRIPTION OF THE DRAWINGS

FIG. 6 is a cross section taken along lines 6—6 in FIG. 5A, showing the inlet valves in the upper manifold.

DESCRIPTION OF THE PREFERRED EMBODIMENTS

Figure 1A:
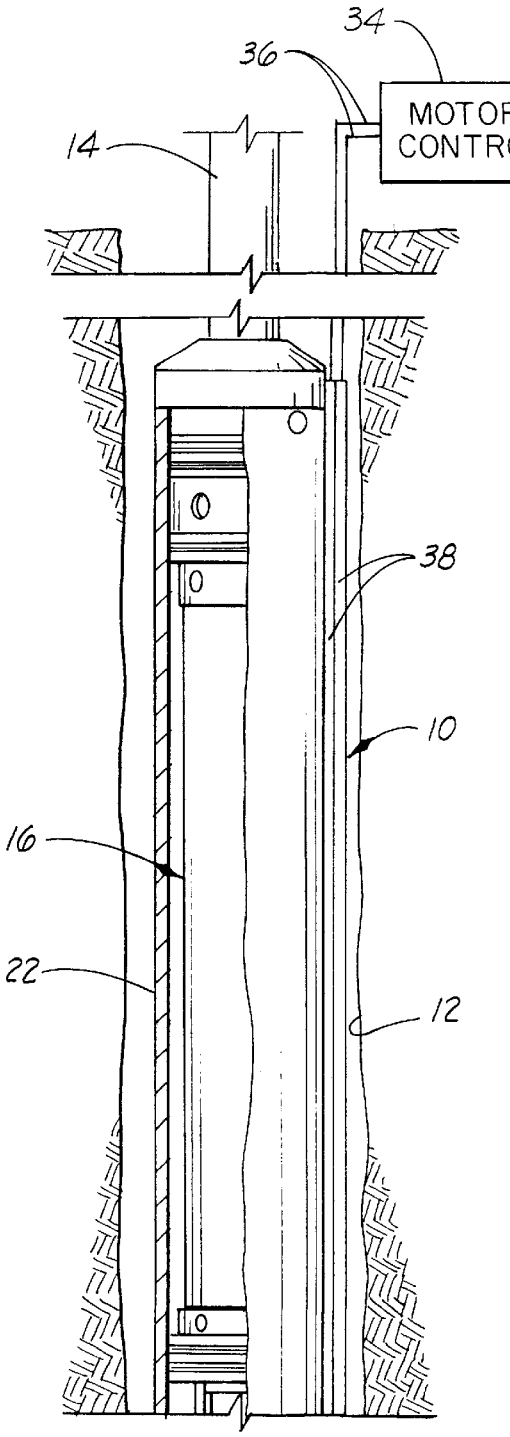
FIGS. 1A and 1B show the solar-powered submersible pump of the present invention in partial cross section in an operating position in a well and further schematically illustrate the energy source and motor control for driving the pump.
Figure 1B:
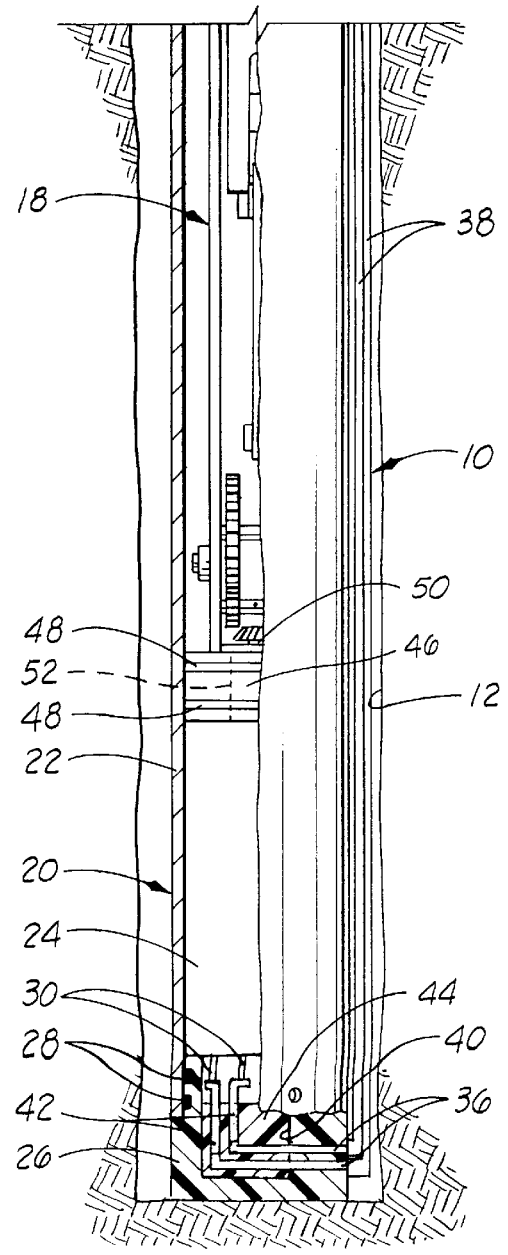

Referring now to the drawings, and more particularly to FIGS. 1A and 1B, the solar-powered submersible pump of the present invention is shown and generally designated by the numeral 10. Pump 10 is designed to be submersed in a well 12 and used to pump fluids therefrom through a discharge pipe or conduit 14. Well 12 may be cased or not as necessary. As illustrated, well 12 is shown as an uncased bore.

Pump 10 is designed to be used as a water well pump. However, the general design and concept of pump 10 and the different embodiments thereof may be adapted for pumping other fluids from a well.

Pump 10 generally comprises a pumping section 16, a transmission section 18 and a drive section 20. Each of the sections is enclosed within an outer case 22.

As seen in FIG. 1B, drive section 20 includes an electric motor 24 with a lower end cap 26 disposed therebelow. Lower end cap 26 is preferably made of a plastic material, such as polyvinylchloride (PVC). Lower end cap 26 is attached to the lower end of outer case 22 in a manner known in the art. A sealing means, such as a plurality of O-rings 28, provides sealing engagement between case 22 and lower end cap 26. Motor 24 is preferably a DC electric motor having a pair of electrical wires 30 extending from a lower end thereof.

Preferably, pump 10 is solar powered, although other electrical sources of power may also be used. As seen in FIG. 1A, a solar cell 32 is connected to a motor control 34. Solar cell 32 may actually comprise a plurality of solar cells in an array and which has a sufficient area for enough solar energy to generate electrical power to drive motor 24. Motor control 34 in this embodiment is of a kind generally known in the art and provides a substantially constant voltage through a pair of wires 36. Wires 36 extend downwardly in well 12 and run through a pair of elongated longitudinally extending sleeves 38 which are attached to case 22.

At the lower end of sleeves 38, wires 36 extend into a cavity 40 defined in lower end cap 26. Wires 36 are attached to a pair of electrical connectors 42 at one end of the connectors. The other end of the connectors are attached to wires 30. This attachment may be by any means known in the art, such as soldering or welding.

Cavity 40 is filled with a plastic material, such as an epoxy resin. In this way, electrical wires 30 are sealingly separated from wires 36, although they are in electrical contact with one another. This is important because wires 30 on motor 24 are generally made of a braided wire configuration, and wires 36 are also generally braided wiring so that they have sufficient flexibility to be easily handled in positioning pump 10 in well 12. If there were a leak in sleeves 38 or the insulation around wires 36 or 30, water could make contact with the wires. Since they are braided, a wicking action may occur which could draw water into pump 10. Electrical connectors 42 are made of solid material, and when embedded in epoxy resin 44, any such migration of water into motor 24 is prevented.

Drive section 20 is connected to transmission section 18 by a motor adapter 46. Motor adapter 46 is preferably made of a plastic material, such as PVC. A sealing means, such as a pair of O-rings 48, provides sealing engagement between case 22 and motor adapter 46. Motor 24 has an upwardly directed output shaft 50 which extends through a hole 52 in motor adapter 46. As will be further described herein, transmission section 18 is designed to convert the rotary output motion of shaft 50 on motor 24 into a reciprocating pumping action within pumping section 16.

Figure 2:
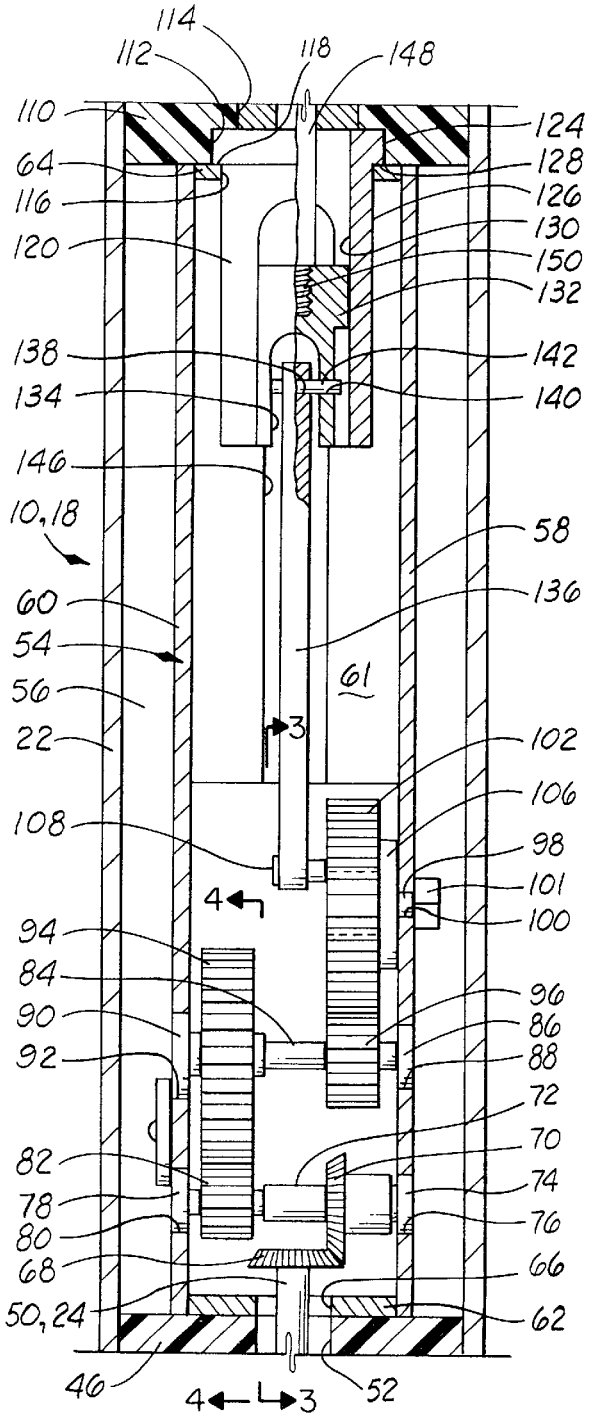
FIG. 2 presents a vertical cross section of a transmission section of a first embodiment of the pump utilizing a gear drive system.
Figure 3:
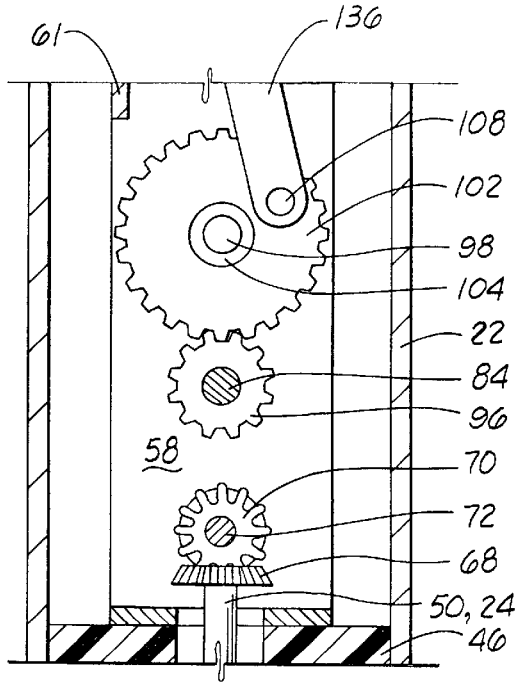
FIG. 3 is a cross section taken along lines 3—3 in FIG. 2, showing the transmission gears with the connecting rod attached to the eccentric shaft.
Figure 4:
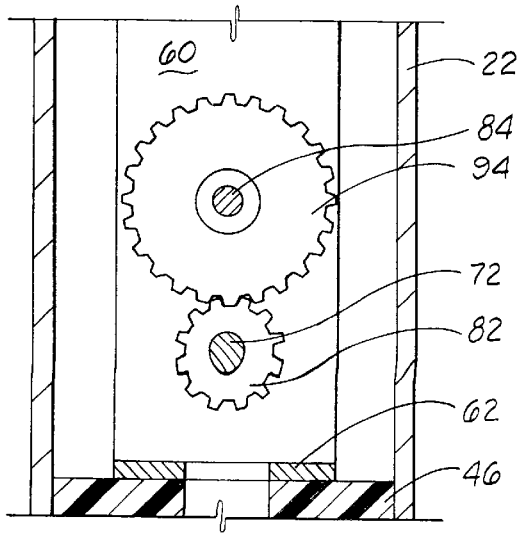
FIG. 4 shows a cross section taken along lines 4—4 in FIG. 2, showing the driver spur gear and the driven sour gear.

Referring now to FIGS. 2–4, the details of a first embodiment of transmission section 18 are shown. A transmission housing 54 is disposed in a cavity 56 within case 22. Housing 54 comprises a pair of spaced, substantially parallel support walls 58 and 60 connected to a transverse wall 61. Support walls 58 and 60 are also attached at their lower ends to a lower end plate 62. Lower end plate 62 in turn is attached to motor adapter 46. The upper ends of support walls 58 and 60 are attached to an upper end plate 64. Lower end plate 62 has a hole 66 therein which is aligned with hole 52 in motor adapter 46. Motor output shaft 50 extends through hole 66 into transmission housing 54.

A drive bevel gear 68 is attached to output shaft 50 of motor 24 in a manner known in the art. Drive bevel gear 68 is engaged with a driven bevel gear 70. Driven bevel gear 70 is mounted on a first gear shaft 72 which extends substantially perpendicularly to output shaft 50 of motor 24. First gear shaft 72 is rotatingly supported at one end by a first bearing 74 disposed in a bearing opening 76 in support wall 58 and at the other end by a second bearing 78 disposed in a bearing opening 80 in support wall 60. Driven bevel gear 70 is disposed adjacent to first bearing 74. A first small drive spur gear 82 is mounted on first gear shaft 72 adjacent to second bearing 78.

A second gear shaft 84 is disposed above and substantially parallel to first gear shaft 72. Second gear shaft 84 is supported on one end by a third bearing 86 disposed in a bearing opening 88 defined in support wall 58 and at the other end by a fourth bearing 90 disposed in another bearing opening 92 defined in support wall 60. A first large driven spur gear 94 is mounted on second gear shaft 84 adjacent to fourth bearing 90. First large spur gear 94 is aligned with and is in geared engagement with first small spur gear 82 on first gear shaft 72. Thus, rotation of first gear shaft 72 results in slower rotation of second gear shaft 84.

A second small drive spur gear 96 is mounted on second gear shaft 84 adjacent to third bearing 86.

A third stationary gear shaft 98 extends through a shaft opening 100 defined in support wall 58. Stationary shaft 98 is attached to support wall 58 by any manner known in the art, such as a nut 101. Stationary shaft 98 is positioned above second gear shaft 84 and is substantially parallel thereto. A second large driven spur gear 102 is rotatingly supported on stationary shaft 98 by fifth bearing 104. A spacer 106 transversely locates second large spur gear 102 on stationary shaft 98. Second large spur gear 102 is aligned with and in geared engagement with second small spur gear 96. It will be seen by those skilled in the art that rotation of second gear shaft 84 thus results in slower rotation of second large spur gear 102. Thus, the combination of first small and large spur gears 82 and 94 and second small and large spur gears 96 and 102 result in a double speed reduction with respect to the speed of motor output shaft 50.

An eccentric shaft 108 is attached to second large spur gear 102 at a position radially spaced from the central axis of second large spur gear 102.

Upper end plate 64 of transmission housing 54 is attached to a lower manifold 110. Lower manifold 110 is preferably made of a plastic material, such as PVC, and the lower manifold defines a first bore 112 and a second bore 114. Second bore 114 is disposed above, and has a smaller diameter than, first bore 112. Upper end plate 64 of transmission housing 54 defines a crosshead guide opening 116 therein which has a diameter somewhat smaller than first bore 112 in lower manifold 110 such that an upwardly facing shoulder 118 is formed on upper end plate 64.

Transmission section 18 also comprises a crosshead guide 120. Crosshead guide 120 has a first outside diameter 124 and a somewhat smaller second outside diameter 126 such that a downwardly facing shoulder 128 is defined therebetween. Second outside diameter 126 is adapted to fit within crosshead guide opening 116 in upper end plate 64 of transmission housing 54, and second outside diameter 124 is sized to fit within first bore 112 of lower manifold 110. Crosshead guide 120 is supported by the engagement of shoulder 128 thereon with shoulder 118 on upper end plate 64.

Crosshead guide 120 defines a vertical crosshead guide bore 130 therein. A crosshead 132 is reciprocably disposed in crosshead guide bore 130. Crosshead 132 has a longitudinally extending slot 134 defined in a lower portion thereof.

An upper end of a connecting rod 136 extends into slot 134 defined in crosshead 132. The upper end of connecting rod 136 has a hole 138 therethrough which is substantially aligned with a transverse hole 140 in crosshead 132. A wrist pin 142 is rotatably disposed through hole 138 and pressed into holes 140 to connect connecting rod 136 to crosshead 132.

The lower end of connecting rod 136 is rotatably mounted on eccentric shaft 108, and thus connected to second large spur gear 102.

Those skilled in the art will see that rotation of second large spur gear 102 will result in reciprocating motion of crosshead 132 within cross head guide 120 because of the interconnection of second large spur gear 102 with crosshead 132 by connecting rod 136. Thus, it will be seen that eccentric shaft 108 acts in the same manner as the throw of a crankshaft. Movement of connecting rod 136 is accommodated by a slot 146 defined in transverse wall 61 of transmission housing 54 and by slot 134 defined in crosshead 132.

Crosshead 132 is guided in crosshead guide bore 130 so that there is substantially no side movement of the crosshead.

The lower end of a plunger rod 148 is attached to crosshead 132 by a threaded connection 150. Thus, plunger rod 148 reciprocates with crosshead 132 and has substantially no side motion.

Figures 5A, 5B:
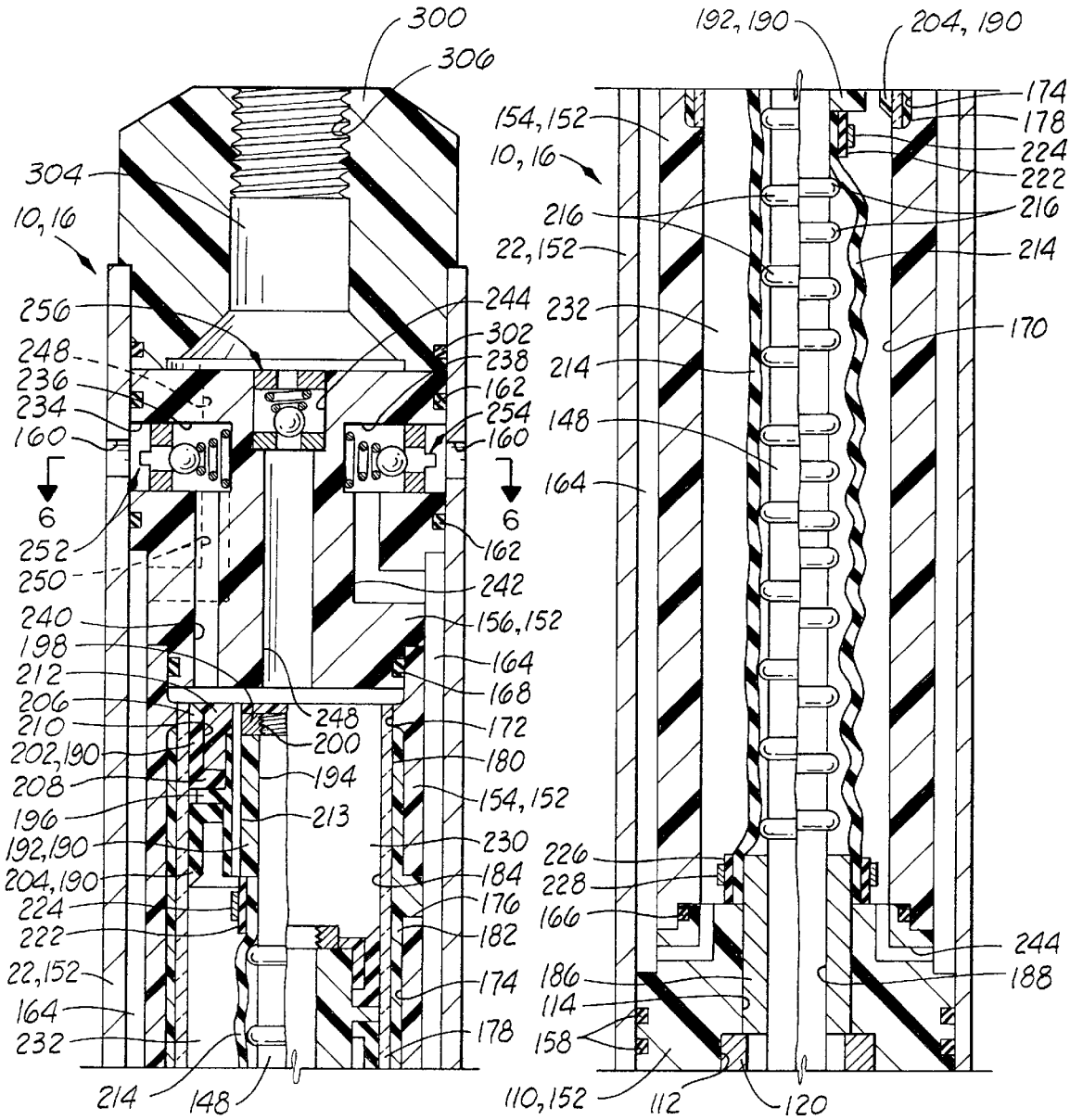
FIGS. 5A and 5B show a vertical cross section of a pumping section of the pump.

Referring now to FIGS. 5A and 5B, the details of pumping section 16 will be discussed. Pumping section 16 comprises a pumping housing 152 formed by a portion of outer case 22, lower manifold 110, a cylinder 154 and an upper manifold 156. A sealing means, such as a plurality of O-rings 158, provides sealing engagement between lower manifold 110 and outer case 22. Cylinder 154 and upper manifold 156 are preferably made of a plastic material, such as PVC.

The upper end of outer case 22 defines a plurality of radially extending inlet ports 160 therein. A sealing means, such as a pair of O-rings 162, provides sealing engagement between upper manifold 156 and outer case 22 on opposite sides of inlet ports 160.

Cylinder 154 extends between the lower end of upper manifold 156 and the upper end of lower manifold 110. Cylinder 154 has an outside diameter smaller than the inside diameter of outer case 22 such that an annular volume 164 is defined between the cylinder and outer case. A sealing means, such as an O-ring 166, provides sealing engagement between lower manifold 110 and the lower end of cylinder 154. Similarly, a sealing means, such as an O-ring 168, provides sealing engagement between cylinder 154 and the lower end of upper manifold 156.

Cylinder 154 has a first bore 170 therein and a somewhat larger second bore 172 at the upper end thereof. Cylinder 154 also defines an annular cavity 174 therein which is in communication with a transverse port 176.

A sleeve 178 is disposed in the upper end of cylinder 154. Sleeve 178 has an outside diameter 180 adapted for fitting within second bore 172 of cylinder 154, and the sleeve is positioned adjacent to cavity 174. Once sleeve 178 is in place, cavity 174 is filled with a filler material, such as epoxy, through port 176. Thus, sleeve 178 is locked into cylinder 154 and essentially becomes an integral part thereof. Sleeve 178 has a bore 184 therethrough and is preferably made of a hard material, such as plexiglass.

A bushing 186 is pressed and/or glued into second bore 114 of lower manifold 110. Plunger rod 148 extends upwardly into cylinder 154 through a bushing bore 188 defined in bushing 186. Bushing bore 188 is sized so that plunger rod 148 is free to reciprocate therein.

A plunger 190 is attached to the upper end of plunger rod 148. Plunger 190 and plunger rod 148 are shown in a top, dead center position on the left side of FIGS. 5A and 5B and are shown in a position displaced partially downwardly in the right side of FIGS. 5A and 5B.

Plunger 190 comprises a plunger body 192 having a central bore 194 defined therein which fits closely around plunger rod 148. Plunger body 192 is generally cylindrical with a radially outwardly extending lip 196 thereon which is located at an intermediate longitudinal position on the plunger body. Plunger body 192 is retained on plunger rod 148 by a nut 198 at threaded connection 200.

Plunger 190 also comprises an upper plunger ring 202 and a lower plunger ring 204. Upper plunger ring 202 is preferably made of a resilient material, such as rubber, and has an upper lip 206 adapted for reciprocating, sealing engagement with bore 184 in sleeve 178. At the lower end of upper plunger ring 202 is a radially inwardly extending ring 208 adapted for engagement with lip 196 on plunger body 192. Lip 206 of upper plunger ring 202 is spaced radially outwardly from plunger body 192 such that an annulus 210 is defined therebetween. Annulus 210 is preferably filled with a filler material, such as epoxy, which also at least partially encloses nut 198 to insure that nut 198 and plunger 190 are locked onto plunger rod 148.

Lower plunger ring 204 is substantially identical to upper plunger ring 202 except that it is positioned in an opposite direction. Those skilled in the art will see that lip 206 on upper plunger ring 202 is adapted to seal as plunger 190 moves upwardly, and the lip on lower plunger ring 204 is adapted to seal as the plunger is moved downwardly.

Plunger 190 has a bleed hole 213 defined longitudinally therethrough. Bleed hole 213 is small enough to have a negligible effect during pumping, but allows equalization of pressure above and below plunger 190 when pump 10 is stopped. This minimizes the load on motor 24 when pump 10 is started.

Figure 8:
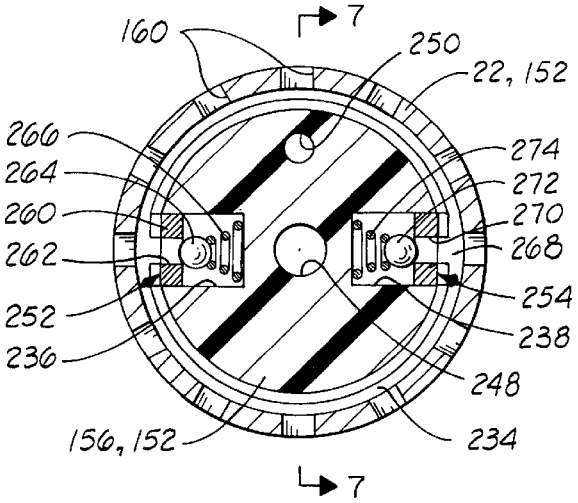
FIG. 8 shows a detail of a bushing which fits on a plunger rod of the pump.
Figure 8:
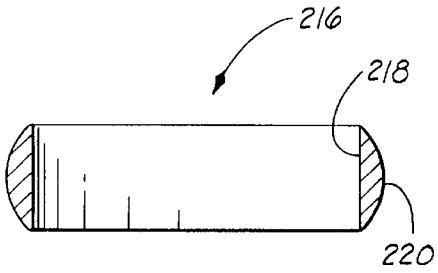

An elongated, elastomeric tube 214 extends between the lower end of plunger body 200 and bushing 186, and the tube is disposed around plunger rod 148. A plurality of tube bushings 216 are disposed between tube 214 and plunger rod 148. A detail of a bushing 216 is shown in FIG. 8. Each bushing 216 has a bore 218 therethrough sized for sliding engagement with plunger rod 148 and a curvilinear outer surface 220 which is engaged by tube 214.

A band 222 is disposed around the upper end of tube 214 and a clamping ring 224 is disposed around band 222. Clamping ring 224 is of a kind known in the art, such as a tubing clamp, and is adapted to clamp onto to band 222 in the upper end of tube 214 to lockingly clamp tube 214 to plunger rod 148 immediately below plunger body 192.

The lower end of tube 214 is positioned around bushing 186, and another band 226 is disposed around this lower end of tube 214. Another clamping ring 228 is disposed around band 226 and is adapted to lockingly clamp onto band 226 and the lower end of tube 214 so that the tube is locked to bushing 186.

In the top dead center position shown in the left side of FIGS. 5A and 5B, it will be seen that tube 214 is extended to substantially its full length, and tube bushings 216 are spaced along plunger rod 148 between the plunger rod and tube 214. As plunger 190 and plunger rod 148 are moved downwardly, tube 214 is compressed so that it deforms into a generally corrugated configuration, as seen in the right side of FIG. 5B. As plunger 190 moves downwardly, bushings 216 slide along plunger rod 148 so that they become closer together. Preferably, but not by way of limitation, when plunger 190 reaches bottom dead center, the series of tube bushings 216 are substantially immediately adjacent to one another. Tube bushings 216 allow tube 214 to be compressed without dragging on the outer surface of plunger rod 148 which would increase the force necessary to reciprocate plunger 190.

Pumping section 16 is designed to be double acting so that plunger 190 displaces liquid on the upstroke and the downstroke thereof. In this way, an upper pumping chamber 230 is defined above plunger 190, and a lower pumping chamber 232 is defined below the plunger.

Figure 7:
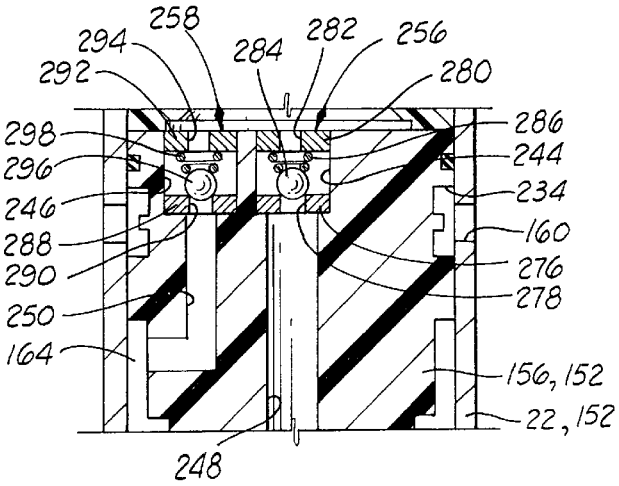
FIG. 7 is a cross section taken along lines 7—7 in FIG. 6, showing the outlet valves in the upper manifold.

Referring now to FIGS. 5A, 6 and 7, details of upper manifold 156 will be discussed. Upper manifold 156 defines an outwardly facing annular groove 234 therein which is aligned and in communication with inlet ports 160 in outer case 22. Inlet manifold 156 defines a first inlet port 236 in communication with groove 234 and a second inlet port 238 also in communication with the groove. A first inlet passageway extends downwardly from first inlet port 236 and provides communication between the first inlet port and upper pumping chamber 232. A second inlet passageway 242 extends from second inlet port 234 and provides communication between the second inlet port and annular volume 164 between outer case 22 and cylinder 154. Referring again to FIG. 5B, a manifold port 244 is defined in lower manifold 110 and provides communication between annular volume 164 and lower pumping chamber 232.

As best seen in FIG. 7, upper manifold 156 further defines a first outlet port 244 therein which is substantially located along a central axis of the inlet manifold. Spaced radially outwardly from first outlet port 244 upper manifold 156 defines a second outlet port 246. A centrally positioned first outlet passageway 248 provides communication between first outlet port 244 and upper pumping chamber 230, and a second outlet passageway provides communication between annular volume 164 and second outlet port 146.

A first inlet valve 252 is disposed in first inlet port 236, a second inlet valve 254 is disposed in second inlet port 238, a first outlet valve 256 is disposed in first outlet port 244 and a second outlet valve 258 is disposed in second outlet port 246.

Referring now to FIG. 6, first inlet valve 252 comprises a first inlet seat 260 defining a first inlet seat port 262 therein. First inlet seat 260 is pressed into first inlet port 236 and acts to retain a first inlet ball 264. A first inlet ball spring 266 biases first inlet ball 264 into sealing engagement with first inlet seat 260 across first inlet seat port 262. Similarly, second inlet valve 254 comprises a second inlet seat 268 defining a second inlet seat port 270 therein, a second inlet ball 272 and a second inlet ball spring 274 which biases the second inlet ball toward second inlet seat 268.

First outlet valve 256 comprises a first outlet seat 276 defining a first outlet seat port 278 therein. First outlet seat 276 is positioned at the lower end of first outlet port 244. A first outlet retainer 280 defining a first outlet retainer port 282 therein is disposed above first outlet seat 276. First outlet retainer 280 holds a first outlet ball 284 and a first outlet ball spring 286 in first outlet port 236. First outlet ball spring 286 biases first outlet ball 284 into sealing engagement with first outlet seat 276 across first outlet seat port 278. Similarly, second outlet valve 258 comprises a second outlet seat 288 defining a second outlet seat port 290 therein, a second outlet retainer 292 defining a second outlet retainer port 294 therein, a second outlet ball 296 and a second outlet ball spring 298.

At the upper end of pump 10 an upper end cap 300 is attached to the upper portion of outer case 22. Upper end cap 300 is preferably made of a plastic material, such as PVC. A sealing means, such as an O-ring 302, provides sealing engagement between upper end cap 300 and outer case 22. Upper end cap 300 defines an outlet chamber 304 therein which is in communication with a threaded opening 306. Threaded opening 306 is adapted for threading engagement with discharge pipe 14.

OPERATION OF THE INVENTION

After pump 10 is positioned in well 12, motor 24 in drive section 20 is actuated by electrical power generated from solar cell 32 or other power source if a solar cell is not used. Motor control 34 controls the power to motor 24 so that a substantially constant voltage is provided. Motor 24 rotates output shaft 50 which results in the reduced speed reduction of second large spur gear 102 as a result of the gear train and transmission section 16 as previously described. This results in actuation of connecting rod 136 and substantially pure reciprocating motion of crosshead 132 and plunger rod 148 as already described. Of course, this reciprocating motion is also transferred to plunger 190.

As plunger 190 moves downwardly from the top dead center position shown in the left side of FIGS. 5A and 5B, lower plunger ring 204 sealingly engages bore 184 in sleeve 178. Also, as plunger 190 moves downwardly, it will be seen that the volume of lower pumping chamber 232 is reduced, and the volume of upper pumping chamber 230 is increased. On the downstroke of plunger 190, water is drawn into upper pumping chamber 230 through first inlet valve 252. Water passes through inlet ports 160 in outer case 22 and into first inlet seat port 262 through groove 234. Pressure differential across first inlet ball 264 compresses first inlet ball spring 266 so that the first inlet ball disengages first inlet seat 260 and water passes through inlet valve 252 and first inlet passageway 240 into upper pumping chamber 230.

Simultaneously on the downstroke of plunger 190, water is forced out of lower pumping chamber 232 through manifold port 244, annular volume 164 and into second outlet passageway 250 and second outlet seat port 290. The pressure differential forces second outlet ball 296 away from second outlet seat 290, compressing second outlet ball spring so that water may flow through second outlet valve 246, discharging through second outlet retainer port 294 and to outlet chamber 304 so that it can flow upwardly through discharge pipe 14.

Once plunger 190 reaches bottom dead center, its motion is reversed. As plunger 190 moves upwardly, the volume of upper pumping chamber 230 is reduced, and the volume of lower pumping chamber 232 is increased. As plunger 190 moves upwardly, water is drawn in through inlet ports 160 in outer case 22, groove 234 and into second inlet seat port 270 of second inlet valve 254. The pressure differential across second inlet ball 272 causes second inlet ball spring 274 to be compressed so that water flows through second inlet valve 254 into second inlet passageway 242, after which it flows through annular volume 164, manifold port 244 into lower pumping chamber 232.

Substantially simultaneously on the upstroke of plunger 190, water is forced out of upper pumping chamber 230 through first outlet passageway 248. The water flows through first outlet valve 256 in a manner previously described for second outlet valve 258. That is, a pressure differential forces first outlet ball 284 to be moved away from first outlet seat 276, compressing first outlet ball spring 286. Water flows through second outlet seat port 278 and second outlet retainer port 282 into outlet chamber 304, after which it flows upwardly through discharge pipe 14.

Second Embodiment

Figure 10:
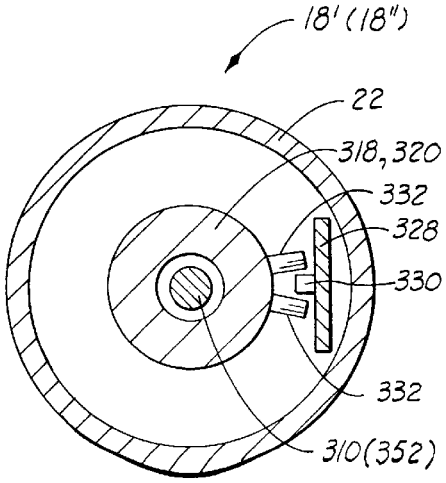
FIG. 10 is a cross section taken along lines 10—10 in FIGS. 9 or 11, showing the guide pins and track for plunger rod.
Figure 9:
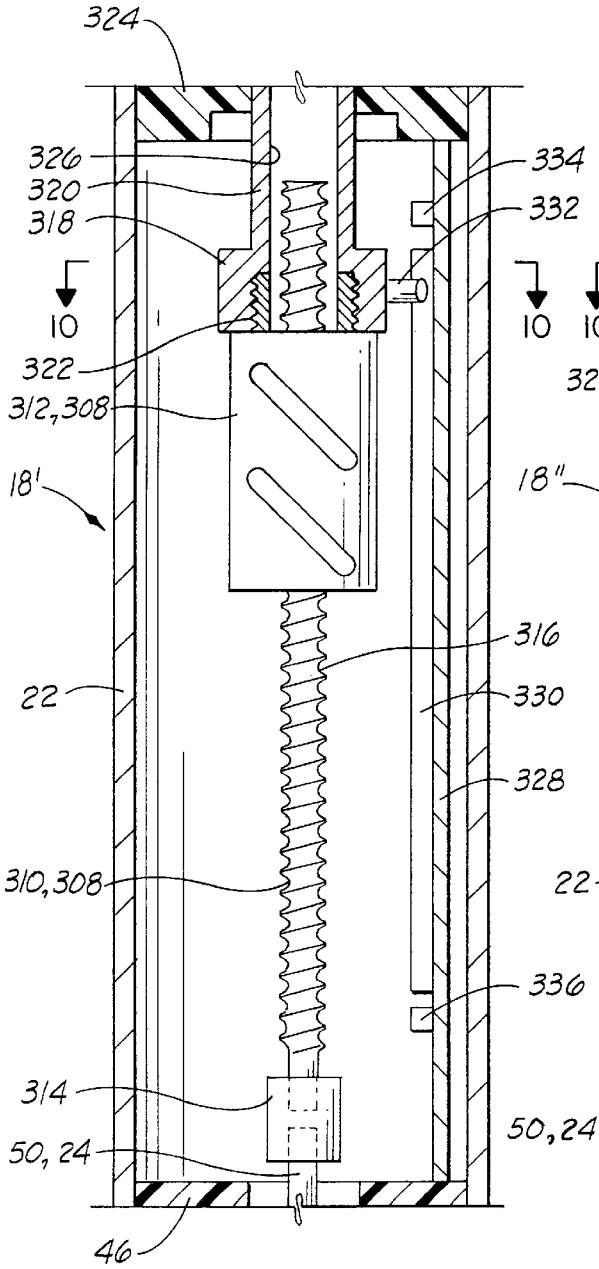
FIG. 9 is a vertical cross section of the transmission section of a second embodiment of the pump, utilizing a ball screw transmission.

Referring now to FIGS. 9 and 10, an alternate embodiment transmission section 18' is shown. In this embodiment, output shaft 50 of motor 24 is connected to a ball screw mechanism 308. Ball screw mechanisms are known devices, and ball screw mechanism 304 comprises a ball screw shaft 310 with a ball screw nut 312 disposed thereon. Ball screw shaft 310 is connected to motor output shaft 50 by a coupling 314 of a kind known in the art. Ball screw shaft 310 is rotatable with respect to ball screw nut 312. Ball screw nut 312 contains a plurality of ball bearings (not shown) which are adapted to roll within a screw-type groove 316 in the outer surface of ball screw shaft 310.

The upper end of ball screw nut 312 is attached to an enlarged lower end 318 of a plunger rod 320 by a threaded connection 322. Plunger rod 320 extends upwardly through a lower manifold 324, similar to the previously described lower manifold 110, and the plunger rod defines a central opening 326 therein adapted for receiving a portion of ball screw shaft 310. The upper portion (not shown) of plunger rod 320 is attached to a plunger in a manner previously described for the first embodiment.

A support wall 328 extends between lower manifold 324 and motor adapter 46. An elongated, longitudinally extending guide track 330 is connected to support wall 328 and is adjacent to ball screw nut 312 and enlarged lower end 318 of plunger rod 320. Attached to lower end 318 of plunger rod 320 are a pair of guide pins which extend radially outwardly and on opposite sides of guide track 330. Guide pins 332 are preferably made of a self-lubricating material, such as nylon, but other materials may also be acceptable. Those skilled in the art will see that the interaction of guide pins 332 with guide track 330 prevents rotation of plunger rod 320 and thus also prevents rotation of ball screw nut 312.

A first sensor 334 is attached to support wall 328 above guide track 330, and a second sensor 336 is attached to support wall 328 below guide track 330.

In the second embodiment of pump 10 using second embodiment transmission section 18', motor 24 must be reversible. This ordinarily does not require special motor construction because most DC motors are reversible.

Motor 24 is energized by electrical power supplied from solar cell 32 through a motor control 34. In this embodiment, motor control 34 is adapted to receive signals from first and second sensors 334 and 336 as described below to alternately reverse motor 24. Motor 24 rotates ball screw shaft 310 in a first direction, for example, counterclockwise as seen in FIG. 10. Rotation of ball screw nut 312 is prevented by the engagement of guide pins 332 with guide track 330 as previously described. Thus, rotation of ball screw shaft 310 results in vertical motion only of ball screw nut 312. For example, counterclockwise rotation of ball screw shaft 310 may result in upward movement of ball screw nut 312 with resulting upward movement of plunger rod 320 and the plunger attached thereto. When lower end 318 of plunger rod 320 comes in close proximity to first sensor 334, the first sensor sends a signal to motor control 34 which reverses the direction of rotation of output shaft 50 of motor 24. That is, if motor output shaft 50 is reversed so that it rotates clockwise as seen in FIG. 10, ball screw nut 312 will move downwardly which, of course, moves plunger rod 320 and the plunger downwardly as well. When ball screw nut 312 comes in close proximity to second sensor 336, another signal is sent to motor control 34 which again reverses the rotation of output shaft 50 of motor 24. This reversing action is repeated throughout the operation of pump 10 utilizing second embodiment transmission section 18'.

Third Embodiment

Figure 11:
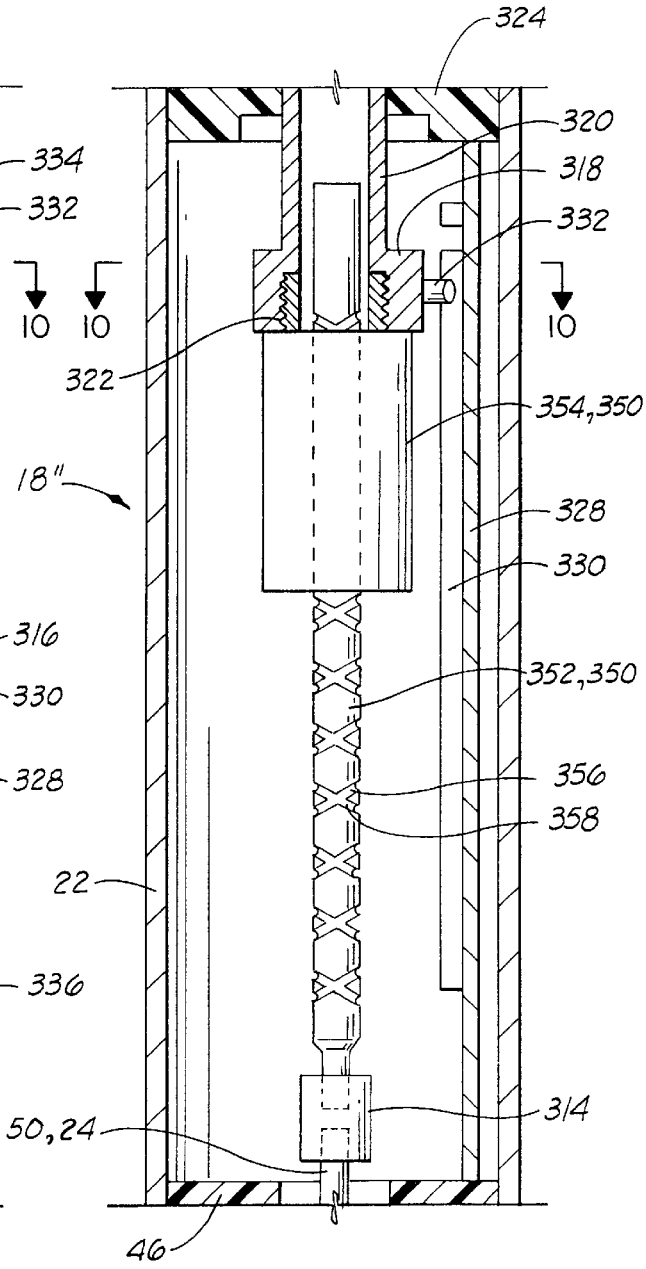
FIG. 11 shows a vertical cross section of the transmission section of a third embodiment of the pump, utilizing a ball screw transmission.

Referring now to FIG. 11, a third embodiment transmission section 18" is shown. Second embodiment transmission section 18" is similar to second embodiment transmission section 18'. However, third embodiment transmission section 18" utilizes a special type of ball screw mechanism 350, such as that sold under the trademark BALL REVERSER by Norco. The BALL REVERSER ball screw 350 comprises a ball screw shaft 352 with a ball screw nut 354 engaged therewith. Ball screw nut 354 is attached to an enlarged lower end 318 of a plunger rod 320, just as the second embodiment, by a threaded connection 322. Thus, reciprocation of ball screw nut 354 results in reciprocation of plunger shaft 320 and the plunger attached thereto in the embodiment of pump 10 utilizing third embodiment transmission section 18".

As with the second embodiment, a support wall 328 extends between a lower manifold 320 and motor adapter 46, and a vertically extending guide track 330 is attached to the support wall. A pair of guide pins 332 extend from enlarged lower end 318 of plunger rod 320, again as in the second embodiment, and these engage guide track 330 in the manner previously described. Thus, FIG. 10 also applies to third embodiment transmission section 18".

The operation of pump 10 utilizing third embodiment transmission section 18 is different from that of the second embodiment. In the third embodiment, reversal of the rotation of output shaft 50 of motor 24 is not required. Ball screw shaft 354 has a special set of interacting grooves 356 and 358 defined on the outer surface thereof. Rotation of ball screw shaft 352 in one direction will result in vertical movement of ball screw nut 354 in an axial direction with respect to ball screw shaft 362. For example, rotation of ball screw shaft 352 in a single direction will initially cause ball screw nut 354 to be moved upwardly with the resulting upward movement of plunger rod 320 and the plunger attached thereto. When ball screw nut 354 reaches a predetermined maximum upward point, it will automatically reverse and move downwardly along ball screw shaft 352 because of the unique interaction of the ball screw nut with grooves 356 and 358 on the ball screw shaft. When ball screw nut 354 reaches a downwardmost point, it will again reverse, and this motion is continued throughout the operation of pump 10 utilizing third embodiment transmission section 18".

An advantage of the third embodiment over the second embodiment is that reversal of motor 24 is not necessary because the rotation of output shaft 50 of the motor in third embodiment transmission section 18" is in only one direction.

It will be seen, therefore, that the solar-powered submersible pump of the present invention is well adapted to carry out the ends and advantages mentioned, as well as those inherent therein. While presently preferred embodiments of the apparatus have been described for the purposes of this disclosure, numerous changes in the arrangement and construction of parts may be made by those skilled in the art. All such changes are encompassed within the scope and spirit of the appended claims.

What is claimed is:

1. A submersible pumping apparatus for use in a well, said apparatus comprising:

a pumping housing having an inlet and an outlet;

a plunger reciprocably disposed in said pumping housing;

a prime mover having a rotating output shaft;

a transmission connected to said plunger and said prime mover, said transmission adapted for converting rotating motion of said output shaft of said prime more into reciprocating motion of said plunger and a plunger rod interconnecting said transmission and said plunger;

said plunger comprising:

a plunger body defining a bore for receiving a portion of said plunger rod therein;

a first plunger first ring disposed on said plunger body and adapted for sealing engagement with said pumping housing as said plunger moves upwardly;

said first plunger ring said plunger body define a cavity therebetween;

a second plunger ring disposed on said plunger body and adapted for sealing engagement with said pumping housing as said plunger moves downwardly; and a locking mechanism for locking said plunger body to said plunger rod;

said locking mechanism comprising a nut threadingly engaged with said plunger rod, and a quantity of epoxy substantially filling said cavity and enclosing at least a portion of said nut.

2. The apparatus of claim 1 wherein said transmission comprises:

a gear train engaged with said output shaft;

a connecting rod engaged with said gear train;

a crosshead connected to said connecting rod;

a crosshead guide in which said crosshead is slidably disposed; and a plunger rod interconnecting said crosshead and said plunger.

3. The apparatus of claim 2 wherein said gear train comprises:

a first bevel gear attached to said output shaft;

a second bevel gear having an axis substantially perpendicular to an axis of said first bevel gear, said first and second bevel gears being in geared engagement; and a plurality of speed reduction gears, one of said speed reduction gears being connected to said second bevel gear and another of said speed reduction gears being connected to said connecting rod.

4. The apparatus of claim 3 wherein said plurality of speed reduction gears comprises:

a first drive spur gear coaxial with said second bevel gear;

a first driven spur gear engaged with said first drive spur gear;

a second drive spur gear coaxial with said first driven spur gear; and a second driven spur gear engaged with said second drive spur gear;

wherein, a first end of said connecting rod is eccentrically attached to said second driven spur gear, and a second end of said connecting rod is pivotally attached to said crosshead.

5. The apparatus of claim 4 wherein said driven spur gears are larger than said drive spur gears.

6. The apparatus of claim 2 further comprising:

a plunger rod interconnecting said plunger and said transmission; and an elastomeric tube disposed around said plunger rod, said tube having a first end attached to said plunger rod and a second end attached to said pumping housing.

7. The apparatus of claim 6 further comprising a plurality of bushings disposed on said plunger rod within said tube.

8. The apparatus of claim 7 wherein each of said bushings has a generally arcuate outer surface.

9. The apparatus of claim 1 wherein said it transmission is characterized by a ball screw comprising:

a ball screw nut connected to said plunger;

a ball screw shaft threadingly engaged with said ball screw nut and having an end connected to said output shaft of said prime mover; and a preventor adapted to prevent rotation of said ball screw nut.

10. The apparatus of claim 9 wherein said means for preventing rotation comprises:

a guide track substantially parallel to said ball screw actuating shaft; and a guide pin operatively connected with said ball screw nut and slidingly engaged with said guide track.

11. The apparatus of claim 9 wherein said motor is reversible.

12. The apparatus of claim 9 further comprising sensing means for sensing a lowermost and an uppermost position of said ball screw nut.

13. The apparatus of claim 9 wherein said plunger rod has a first end attached to said plunger and a second end attached to said ball screw nut, said plunger rod defining a central opening therein and at least a portion of said ball screw shaft is disposed in said central opening.

14. The apparatus of claim 9 wherein said ball screw is a reversing ball screw which reciprocates said ball screw nut along said ball screw shaft in response to rotation of said ball screw shaft in a single direction.

15. The apparatus of claim 1 wherein said pumping housing comprises:

an outer case portion, said inlet being a case inlet port defined in said outer case portion;

a cylinder disposed in said outer case portion such that a substantially annular volume is defined therebetween, said plunger being reciprocably disposed in said cylinder such that an upper pumping chamber is defined in said cylinder above said plunger and a lower pumping chamber is defined in said cylinder below said plunger;

a lower manifold engaged with said outer case portion and a lower portion of said cylinder, said lower manifold defining a manifold port therein which provides communication between said lower pumping chamber and said annular volume; and an upper manifold engaged with said outer case portion and an upper portion of said cylinder, said upper manifold defining:

a first inlet passageway providing communication between said case inlet port and said upper pumping chamber;

a second inlet passageway providing communication between said case inlet port and said annular volume;

a first outlet passageway providing communication between said upper pumping chamber and said outlet of said pumping housing; and a second outlet passageway providing communication between said annular volume and said outlet of said pumping housing.

16. The apparatus of claim 15 further comprising:

a first inlet valve in communication with said first inlet passageway;

a second inlet valve in communication with said second inlet passageway;

a first outlet valve in communication with said first outlet passageway; and a second outlet valve in communication with said second outlet passageway.

17. The apparatus of claim 15 further comprising a glass liner disposed in said cylinder and engaged with said plunger.

18. The apparatus of claim 17 wherein said cylinder defines a cavity adjacent to said glass liner; and further comprising a quantity of epoxy substantially filling said cavity to lock said glass liner with respect to said cylinder.

19. The apparatus of claim 1 wherein said prime mover is an electric motor having a plurality of wires extending therefrom; and further comprising:

an end cap positioned adjacent to said motor, said end cap defining a cavity therein;

a plurality of wires extending externally of said pumping housing;

a plurality of electrical connectors disposed in said cavity of said end cap, each of said connectors being adapted for electrically interconnecting one of said plurality of wires extending from said motor with a corresponding one of said plurality of wires extending externally of said pump housing; and a quantity of epoxy substantially filling said cavity in said end cap and enclosing at least a portion of said connectors such that liquid which may be on said wires extending externally of said pumping housing cannot come in contact with said wires extending from said motor.

20. A pump comprising:

a pumping housing having an inlet and an outlet;

a plunger reciprocably disposed in said pumping housing;

a transmission housing attached to said pumping housing;

a prime mover attached to said transmission housing and having a rotating output shaft extending into said transmission housing;

a first bevel gear attached to said output shaft;

a second bevel gear engaged with said first bevel gear and having an axis substantially perpendicular to an axis of said first bevel gear;

a speed reduction gear train disposed in said transmission housing and connected to said second bevel gear;

a crosshead guide adjacent to said transmission housing;

a crosshead reciprocably disposed in said crosshead guide and connected to said plunger;

a connecting rod interconnecting said crosshead and said gear train;

a plunger rod interconnecting said plunger and said crosshead;

an elastomeric tube disposed around said plunger rod, said tube having a first end attached to said plunger rod and a second end attached to said pumping housing; and, a plurality of bushings slidably disposed on said plunger rod within said tube.

21. The pump of claim 20 wherein said gear train comprises:

a first gear shaft on which said second bevel gear is disposed, said first gear shaft being substantially perpendicular to said output shaft of said prime mover;

a first drive gear disposed on said first gear shaft;

a second gear shaft substantially parallel to said first gear shaft;

a first driven gear disposed on said second gear shaft and engaged with said first drive gear;

a second drive gear disposed on said second gear shaft;

a third gear shaft disposed substantially parallel to said first and second gear shafts; and a second driven gear disposed on said third gear shaft and engaged with said second drive gear;

wherein, said connecting rod is eccentrically connected to said second drive gear.

22. The pump of claim 21 wherein said drive gears and said driven gears are spur gears.

23. The pump of claim 20 wherein each of said bushings has a generally arcuate outer surface.

24. The pump of claim 20 wherein said pumping housing comprises:

an outer case portion, said inlet being a case inlet port defined in said outer case portion;

a cylinder disposed in said outer case portion such that a substantially annular volume is defined therebetween, said plunger being reciprocably disposed in said cylinder such that an upper pumping chamber is defined in said cylinder above said plunger and a lower pumping chamber is defined in said cylinder below said plunger;

a lower manifold engaged with said outer case portion, a lower portion of said cylinder and said transmission housing, said lower manifold defining a manifold port therein providing communication between said lower pumping chamber and said annular volume; and an upper manifold engaged with said outer case portion and an upper portion of said cylinder, said upper manifold defining:

a first inlet passageway providing communication between said case inlet port and said upper pumping chamber;

a second inlet passageway providing communication between said case inlet port and said annular volume;

a first outlet passageway providing communication between said upper pumping chamber and said outlet of said pumping housing; and a second outlet passageway providing communication between said annular volume and said outlet of said pumping housing.

25. The pump of claim 24 further comprising a check valve disposed in each of said passageways.

26. The pump of claim 24 further comprising a glass liner disposed in said cylinder and engaged with said plunger.

27. The pump of claim 26 further comprising a plunger rod connected to said plunger;

wherein, said plunger comprises:

a plunger body;

a first plunger ring disposed on said plunger body and adapted for sealing engagement with said cylinder;

a second plunger ring disposed on said body and adapted for sealing engagement with said cylinder; and means for locking said plunger body to said plunger rod.

28. The pump of claim 27 wherein:

said first plunger ring and said plunger body define a cavity therebetween; and said means for locking comprises:

a nut threadingly engaged with said plunger rod; and a quantity of epoxy substantially filling said cavity and enclosing at least a portion of said nut.

29. A pumping apparatus comprising:

a pumping housing having an inlet and an outlet;

a plunger reciprocably disposed in said pumping housing;

a transmission housing connected to said pumping housing;

a prime mover having a rotating output shaft extending into said transmission housing;

a ball screw having a ball screw nut connected to said plunger, a ball screw shaft threadingly engaged with said ball screw nut and having an end connected to said output shaft of said prime mover, and a preventor adapted to prevent rotation of said ball screw nut with respect to said transmission housing;

a plunger rod interconnecting said plunger and said ball screw nut;

an elastomeric tube disposed around said plunger rod, said tube having a first end attached to said plunger rod and a second end attached to said pumping housing; and a plurality of bushings slidably disposed on said plunger rod within said tube.

30. The apparatus of claim 29 wherein said means for preventing rotation comprises:

a guide track disposed in said transmission housing; and a guide pin operatively connected with said ball screw nut and slidingly engaged with said guide track.

31. The apparatus of claim 29 wherein said motor is reversible.

32. The apparatus of claim 29 further comprising sensing means for sensing an upper position of said ball screw nut and a lower position of said ball screw nut.

33. The apparatus of claim 32 wherein said means for preventing rotation comprises:

a guide track disposed in said transmission housing adjacent to said ball screw nut; and a guide pin operatively connected with said ball screw nut and slidingly engaged with said guide track.

34. The apparatus of claim 33 wherein said sensing means comprises:

a first sensor disclosed above said guide track; and a second sensor disposed below said guide track.

35. The apparatus of claim 29 wherein said plunger rod has a first end attached to said plunger and a second end attached to said ball screw nut, said plunger rod defining a central opening therein and at least a portion of said ball screw shaft is disposed in said central opening.

36. The apparatus of claim 29 wherein said ball screw is a reversing ball screw which alternately reverses the direction of longitudinal movement of said ball screw nut with respect to said ball screw shaft when said ball screw nut reaches uppermost and lowermost positions thereof, while said ball screw shaft is rotated in a single direction.

37. The apparatus of claim 29 wherein said pumping housing comprises:

an outer case portion, said inlet being a case inlet port defined in said outer case portion;

a cylinder disposed in said outer case portion such that a substantially annular volume is defined therebetween, said plunger being reciprocably disposed in said cylinder such that an upper pumping chamber is defined in said cylinder above said plunger and a lower pumping chamber is defined in said cylinder below said plunger;

a lower manifold engaged with said outer case portion, a lower portion of said cylinder and said transmission housing, said lower manifold defining a manifold port therein providing communication between said lower pumping chamber and said annular volume; and an upper manifold engaged with said outer case portion and an upper portion of said cylinder, said upper manifold defining:

a first inlet passageway providing communication between said case inlet port and said upper pumping chamber;

a second inlet passageway providing communication between said case inlet port and said annular volume;

a first outlet passageway providing communication between said upper pumping chamber and said outlet of said pumping housing; and a second outlet passageway providing communication between said annular volume and said outlet of said pumping housing.

38. The apparatus of claim 37 further comprising a check valve disposed in each of said passageways.

39. The apparatus of claim 37 further comprising a glass liner disposed in said cylinder and engaged with said plunger.

40. The apparatus of claim 29 further comprising a plunger rod interconnecting said plunger and said ball screw shaft;

wherein, said plunger comprises:

a plunger body;

a first plunger ring disposed on said plunger body and adapted for sealing engagement with said pumping housing;

a second plunger ring disposed on said plunger body and adapted for sealing engagement with said pumping housing; and means for locking said plunger body to said plunger rod.

41. A pumping apparatus comprising:

a pumping housing having an inlet and an outlet;

a plunger reciprocably disposed in said pumping housing;

a transmission housing connected to said pumping housing;

a prime mover having a rotating output shaft extending into said transmission housing; and a ball screw comprising;

a ball screw nut connected to said plunger;

a ball screw shaft threadingly engaged with said ball screw nut and having an end connected to said output shaft of said prime mover; and a preventor adapted to prevent rotation of said ball screw nut with respect to said transmission housing a plunger rod interconnecting said transmission and said plunger;

said plunger comprises;

a plunger body;

a first plunger ring disposed on said plunger body and adapted for sealing engagement with said pumping housing, said first plunger ring and said plunger body define a cavity therebetween;

a second plunger ring disposed on said plunger body and adapted for sealing engagement with said pumping housing; and a locking mechanism adapted to lock said plunger body to said plunger rod; and said locking means comprises:

a nut threadingly engaged with said plunger rod; and
a quantity of epoxy substantially filling said cavity and enclosing at least a portion of said nut.

42. A pumping apparatus comprising:

an outer case defining an inlet and an outlet therein;

a cylinder disposed in said outer case such that a substantially annular volume is defined therebetween;

a plunger reciprocably disposed in said cylinder such that an upper pumping chamber is defined in said cylinder above said plunger and a lower pumping chamber is defined in said cylinder below said plunger;

a glass liner disposed in said cylinder and engaged with said plunger;

said plunger comprises:

a plunger body defining a bore for receiving a portion of said plunger rod therein;

a first plunger ring disposed on said plunger body and adapted for sealing engagement with said glass liner as said plunger moves upwardly, said first plunger ring and said plunger body define a cavity therebetween;

a second plunger ring disposed on said plunger body and adapted for sealing engagement with said glass liner as said plunger moves downwardly; and means for locking said plunger body to said plunger rod said locking means comprising;

a nut threadingly engaged with said plunger rod; and a quantity of epoxy substantially filling said cavity and enclosing at least a portion of said nut; and a lower manifold engaged with said outer case and a lower portion of said cylinder, said lower manifold defining a lower manifold port therein which provides communication between said lower pumping chamber and said annular volume;

an upper manifold engaged with said outer case and an upper portion of said cylinder, said upper manifold defining:

a first inlet passageway providing communication between said inlet and said upper pumping chamber;

a second inlet passageway providing communication between said inlet and said annular volume;

a first outlet passageway providing communication between said upper pumping chamber and said outlet; and a second outlet passageway providing communication between said annular volume and said outlet; and a reciprocator adapted to reciprocate said plunger in said cylinder.

43. The apparatus of claim 42 further comprising:

a first inlet valve in communication with said first inlet passageway;

a second inlet valve in communication with said second inlet passsageway;

a first outlet valve in communication with said first outlet passageway; and a second outlet valve in communication with said second outlet passageway.

44. The apparatus of claim 43 wherein said inlet valves and said outlet valves are characterized by ball check valves.

45. The apparatus of claim 42 wherein said cylinder defines a cavity adjacent to said glass liner; and further comprising a quantity of epoxy substantially filling said cavity for locking said glass liner in said cylinder.

46. A submersible pumping apparatus for use in a well, said apparatus comprising:

a pumping section;

a motor having a rotating output shaft and having a plurality of motor wires extending therefrom;

a transmission section interconnecting said pumping section and said motor;

an end cap adjacent to said motor and defining a cavity therein;

a plurality of external wires adjacent to said end cap and extending upwardly in the well;

a plurality of substantially solid electrical connectors disposed in said cavity, each of said electrical connectors being adapted for electrically interconnecting one of said motor wires with one of said external wires; and a quantity of epoxy substantially filling said cavity and thereby enclosing at least a portion of said electrical connectors such that liquid from said well which may be in contact with said external wires cannot come in contact with said motor wires.

47. A pumping apparatus comprising:

a pumping housing;

a plunger reciprocably disposed in said pumping housing;

a plunger rod connected to said plunger and reciprocable therewith;

an elastomeric tube disposed around said plunger rod, said tube having a first end sealingly attached to said plunger rod and a second end sealingly attached to said pumping housing; and a plurality of bushings slidably disposed on said plunger rod within said tube.

48. The apparatus of claim 47 wherein each of said bushings has a generally arcuate outer surface.

* * * * *